US006428907B1

(12) United States Patent
Mehdianpour et al.

(10) Patent No.: US 6,428,907 B1
(45) Date of Patent: Aug. 6, 2002

(54) POSITIONING ARM FOR POSITIONING AND ASSEMBLING SYSTEMS AND METHOD FOR PRODUCING POSITIONING ARMS

(75) Inventors: Mohammad Mehdianpour, München; Peter Drexel, Gröbenzell; Bernd-Friedrich Scholl, Echterdingen; Helmut Macht, Kümmersbruck, all of (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/646,148

(22) PCT Filed: Feb. 17, 1999

(86) PCT No.: PCT/DE99/00438

§ 371 (c)(1),
(2), (4) Date: Sep. 13, 2000

(87) PCT Pub. No.: WO99/47717

PCT Pub. Date: Sep. 23, 1999

(30) Foreign Application Priority Data

Mar. 17, 1998 (DE) ..... 198 11 612

(51) Int. Cl.[7] ..... B32B 5/18; B32B 15/00; C22C 1/08

(52) U.S. Cl. ..... 428/613; 428/614; 428/469; 428/307.3; 428/699; 164/98; 164/108

(58) Field of Search ..... 428/613, 621, 428/469, 307.3, 614, 699; 164/98, 108, 109, 111, 79; 264/45.1, 46.1, 46.9

(56) References Cited

U.S. PATENT DOCUMENTS 3,930,627 A * 1/1976 Miller ..... 244/121
5,350,609 A 9/1994 Bouchemousse ..... 428/34.4
5,482,533 A * 1/1996 Masuda et al. ..... 75/415
5,564,064 A * 10/1996 Martin ..... 419/5
5,627,701 A * 5/1997 Misso et al. ..... 360/106
5,849,406 A * 12/1998 Daws ..... 428/312.2
5,927,129 A * 7/1999 Thoms et al. ..... 72/268

FOREIGN PATENT DOCUMENTS

| | | |
|---|---|---|
| DE | 40 40 354 | 7/1992 |
| DE | 42 06 303 | 6/1993 |
| DE | 2 274 118 | 7/1994 |
| DE | 43 10 248 | 10/1995 |
| DE | 686 251 | 2/1996 |

(List continued on next page.)

OTHER PUBLICATIONS

Research Disclosure 26957, Sep. 1986, "Use of Ceramic Foam Materials in Head–Disk Assemblies", p. 563, No Date.*
Patent Abstracts of Japan—07144264—06–06–95—European Patent Office, No Date.
Patent Abstracts of Japan—63268551—07–11–88—European Patent Office, No Date.
Patent Abstracts of Japan—63242461—07–10–88—European Patent Office, No Date.
Patent Abstracts of Japan—07088996—04–04–95—European Patent Office, No Date.

*Primary Examiner*—John J. Zimmerman
(74) *Attorney, Agent, or Firm*—Harness, Dickey & Pierce P.L.C.

(57) ABSTRACT

Positioning arms for positioning and assembling systems are subjected to high accelerations and must therefore be made lightweight but nevertheless resistant to bending and twisting. The use of composite materials based on metal or ceramic foams and non-expanded materials for positioning arms in positioning and assembling systems allows these positioning arms to be lightweight and nevertheless to have high rigidity. Semifinished products are arranged in the non-expanded material, since a better connection between the semifinished product and material is ensured there than in the metal or ceramic foam.

26 Claims, 6 Drawing Sheets

FOREIGN PATENT DOCUMENTS

| | | | |
|---|---|---|---|
| DE | 195 01 508 | | 4/1996 |
| DE | 19753358 A1 | * | 7/1999 |
| JP | 58-102304 | * | 6/1983 |
| JP | 63-22460 | * | 1/1988 |
| JP | 63-268551 | * | 11/1988 |
| JP | 1-92460 | * | 8/1989 |
| JP | 3-271448 | * | 12/1991 |
| JP | 7-144264 | * | 6/1995 |
| WO | WO 97/38808 | | 10/1997 |
| WO | WO 99/25432 | * | 5/1999 |

* cited by examiner

FIG 1a
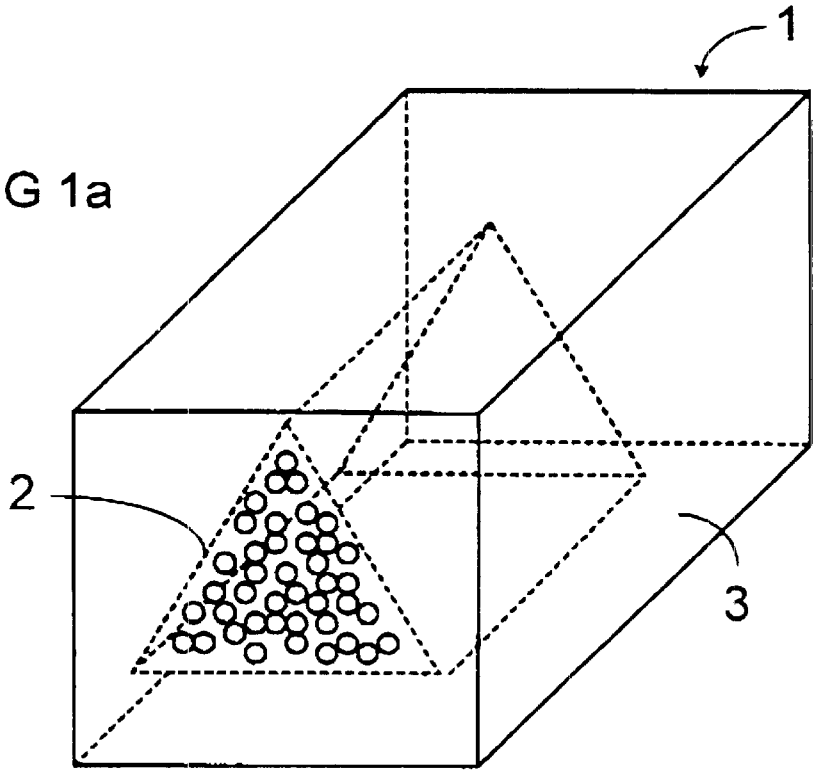
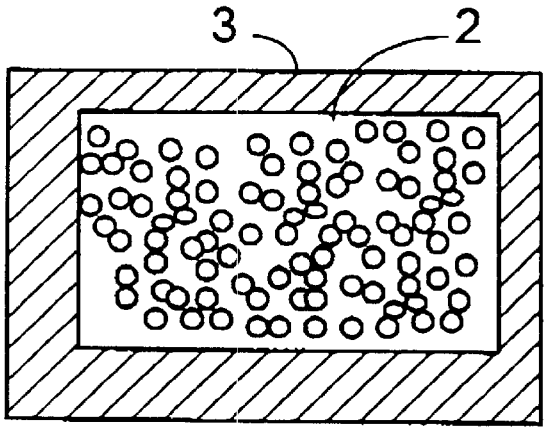
FIG 1b
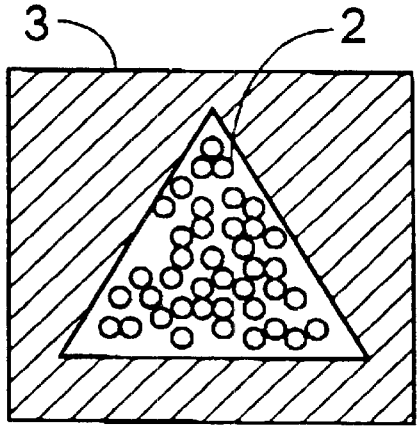
FIG 1c

FIG 2a
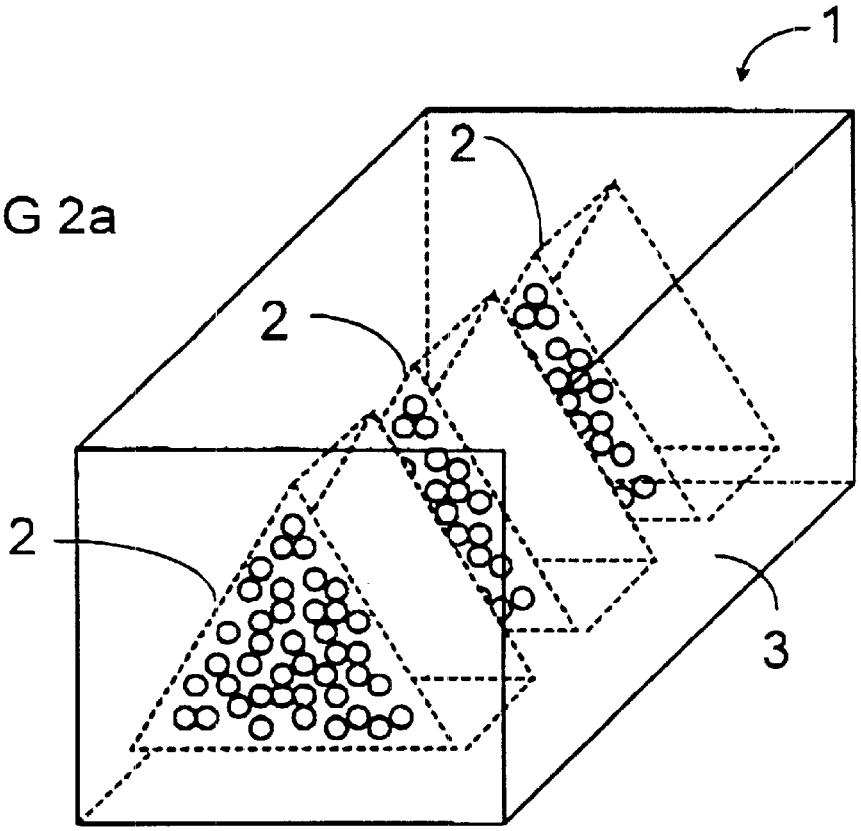
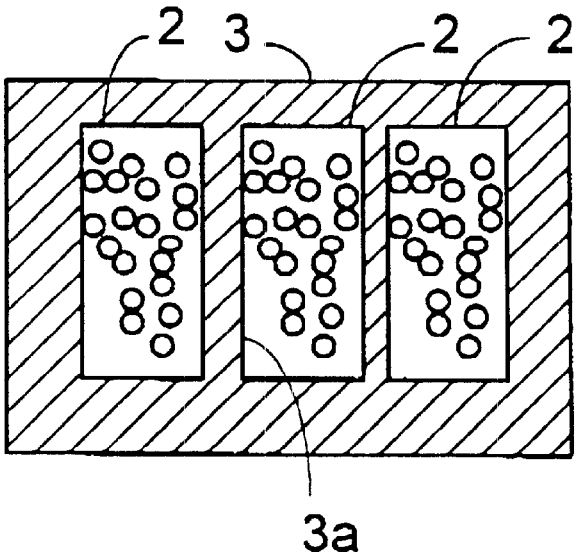
FIG 2b
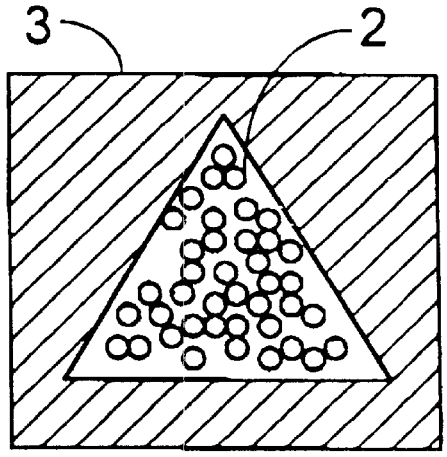
FIG 2c

POSITIONING ARM FOR POSITIONING AND ASSEMBLING SYSTEMS AND METHOD FOR PRODUCING POSITIONING ARMS

BACKGROUND OF THE INVENTION

In positioning and assembling systems, such as for example SMD (surface mounted device) automatic placement machines, the positioning unit must be moved in the X and Y directions. For the X, Y positioning axes, a space-saving portal type of construction is preferred here, in which a positioning arm itself can be moved for example in the X direction, while a slide unit arranged in the horizontal region of the positioning arm permits the moving of the positioning unit fastened thereto in the Y direction. To achieve high accelerations for positioning arms of this type, which may also be designed as a portal, with low driving power and braking power, the moved mass must be kept as small as possible. On the other hand, however, there is the necessity of making the positioning arms resistant to bending and twisting.

Bending- and twisting-resistant positioning arms for positioning and assembling systems are usually produced as welded constructions, as a high-grade steel precision-casting construction or as a composite of high-grade steel precision-cast and welded parts. Furthermore, aluminum extruded shapes, aluminum castings and ceramic materials as well as fiber composites such as glass-fiber or carbon-fiber reinforced laminates are used.

In the production of the bending- and twisting-resistant positioning arms by precision casting, first corresponding models are prepared, these so-called "lost" models usually consisting of waxes, thermoplastic materials, urea or mixtures thereof.

CH 686 251 discloses a method for producing lightweight, bending- and twisting-resistant portals, in particular portals in automatic placement machines, in which a model is produced from a material capable of melting, dissolving out and/or burning out and is subsequently provided with a ceramic slip by coating and with a ceramic shell by subsequent drying. After removal of the model, for example by melting out, the portal is completed by firing. Disadvantages of the use of ceramic materials are on the one hand the lack of suitable, inexpensive techniques for connecting ceramic workpieces to one another and to workpieces based on a different material, for example a metallic material, and on the other hand the high brittleness of ceramic material, which under loading can easily lead to the breaking up of a portal.

Lightweight, bending-resistant materials based on metal foams are likewise known. DE 42 06 303 discloses a method for producing metal foam bodies in which a metal powder is mixed with a blowing agent powder, the powder mixture is brought to an elevated temperature in a recipient and is extruded through a die. Thereafter, the extruded part is expanded by heating, with the blowing agent powder being decomposed, and is cooled as the finished foam body.

DE 195 01 508 discloses a component for the chassis of a motor vehicle and a method for producing such a component, the component consisting of an aluminum diecasting and having a cavity profile, in the cavity of which there is a core of aluminum foam.

However, the foam-like structure of the workpieces makes it difficult to realize releasable connections between these workpieces and other workpieces. Semifinished products incorporated into the metal foam generally do not withstand strong tensile or torsional stress, since the contact surface with respect to the semifinished product is reduced on account of the structure of the metal foam.

SUMMARY OF THE INVENTION

It is an object of the invention specify a positioning arm and a flexible method for producing positioning arms, it being intended for these positioning arms to have on the one hand the highest possible resistance to bending and twisting and on the other hand the lowest possible weight. The method is at the same time intended to be particularly suitable for the production of lightweight, bending- and twisting-resistant positioning arms for positioning and assembling systems.

According to the method and apparatus of the invention for a positioning arm for positioning an assembling system, at least one core and an outer layer enclosing the core are provided. The core is formed of a metal or surrounding foam and the outer layer is formed of a non-expanded material.

In another embodiment of the apparatus and method of the invention, a positioning arm is provided for positioning and assembling systems wherein at least one core and an outer layer enclosing the core are provided. The core is formed of a non-expanded material and the outer layer is formed of a metal or ceramic foam.

Consequently, a positioning arm of the composite material: metal or ceramic foam/metallic or ceramic material is not to be regarded as hollow, like castings of steel, aluminum or ceramic, but as solid material, and therefore has a high twisting resistance and does not spring back when subjected to accelerations.

In this case, both cores of metal or ceramic foam which are surrounded by non-expanded material and cores of non-expanded material as the core which are surrounded by an outer layer of metal or ceramic foam can be realized, which leads to great flexibility in the shaping of the positioning arms.

In one embodiment of the invention, instead of one core, a plurality of cores are jointly surrounded by the outer layer, which allows more flexible shaping of the positioning arm while retaining a standard form for cores. In addition, separating walls of solid material are produced between the cores, thereby increasing the rigidity of the positioning arm. In the case of conventional sand casting methods, such separating walls are not feasible, since the sand has to be removed again after the casting.

In a further advantageous configuration of the positioning arm further flexibility is provided in the shaping of the positioning arm by the use of multilayer structures, with metal or ceramic foams and non-expanded materials alternating.

Semifinished products are at least partly arranged in the non-expanded material. This produces a solid connection of the semifinished product in the positioning arm and consequently simple connections of the positioning arm to further workpieces can be realized. For example, in this way it is possible to provide a casting around threads, which are then used for screw connections or else tubular semifinished products as a simple form of cable bushings, which when used in automatic placement machines serve for supplying power and data to placement heads attached to the positioning arm.

The use of aluminum or aluminum alloys as the metal foam and/or non-expanded material leads to particularly positioning arms by virtue of the low specific weight of aluminum. Although the modulus of elasticity of aluminum foam materials, at approx. 5 GPa, is lower than for aluminum (69 GPa), ceramic (approx. 300 GPa) or steel (approx. 210 GPa), its low density (300–1000 kg/m$^3$) in comparison with the other materials (aluminum: 2700 kg/M$^3$, ceramic: approx. 4000 kg/m$^3$, steel approx. 8000 kg/m$^3$) has the effect of producing a high specific bending resistance, which is further improved by combination with other materials.

On account of its high rigidity, a ceramic material is also suitable in an advantageous lacuna as a non-expanded material.

Exemplary embodiments of the invention are described in more detail below and are represented in the drawing.

BRIEF DESCRIPTION OF THE DRAWINGS

FIG. 1*a* shows a core of a metal or ceramic foam with an outer layer of a non-expanded material, FIGS. 1*b* and 1*c* show a core of a metal or ceramic foam which is surrounded by an outer layer of a non-expanded material, in longitudinal section and in cross section, FIG. 2*a* shows part of a positioning arm which has been produced by casting around a plurality of cores, with the associated longitudinal section in FIG. 2*b* and cross section in FIG. 2*c,*

DESCRIPTION OF THE PREFERRED EMBODIMENTS

Figure 3:
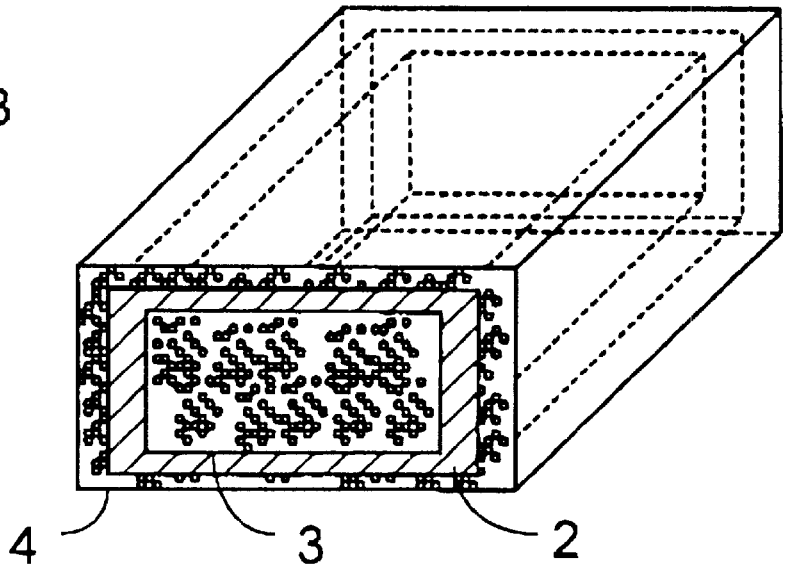
FIG. 3 shows a layered structure of metal or ceramic foam and non-expanded materials.

In FIG. 1 it is shown how part of a positioning arm 1 of a positioning and assembling system is constructed from a core 2 of metal or ceramic foam which is cast around by an outer layer 3 of a metallic or ceramic material. For the casting-around operation, a low-pressure casting method is used here. In a preferred embodiment, a core 2 of aluminum foam has aluminum or an aluminum alloy cast around it. On account of the lower density of the aluminum foam, a weight reduction in comparison with solid positioning arms formed of aluminum is achieved. In comparison with known methods of weight reduction by casting around cores which can be dissolved out, in the method according to the invention the cores remain in the positioning arm, which simplifies production. Suitable for example as the ceramic foam are aluminum silicate or aluminum oxide fibers or alkaline earth metal silicate fibers treated by the vacuum suction method.

As shown in FIG. 2, the method can be varied, in that for example a plurality of cores 2 of aluminum foam material have a metallic or ceramic material 3 jointly cast around them. This produces between the cores 2 separating walls 3*a* of the metallic or ceramic material 3, which ensure a greater rigidity of the positioning arm. In the case of conventional casting methods with sand cores, such separating walls cannot be produced, since the sand cores have to be removed again through holes after the casting.

By repeated application of the methods of casting around and surrounding with metal or ceramic foam, layered structures are possible, as shown by way of example in FIG. 3. Here, a core 2 of metal or ceramic foam has had a metallic or ceramic material 3 cast around it, which is subsequently surrounded by a further layer 4, for example of a further metal or ceramic foam, which absorbs impact energy particularly well.

Figure 4:
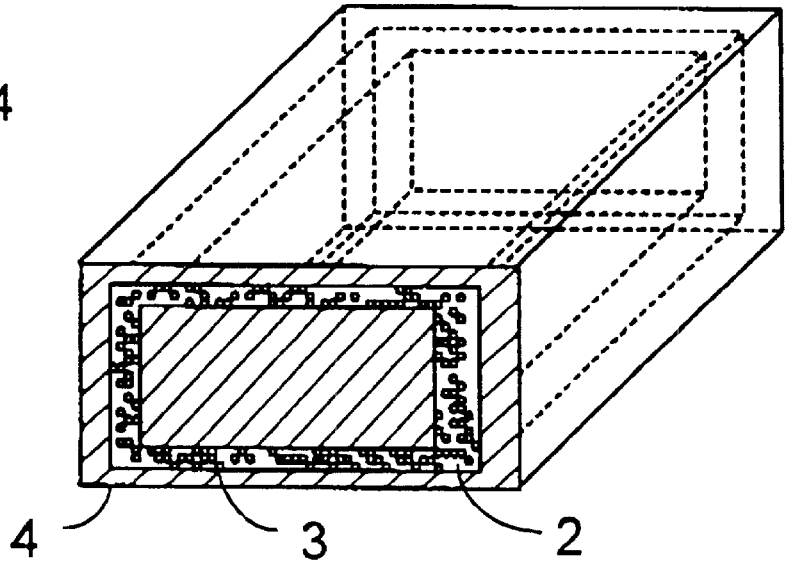
FIG. 4 shows part of a positioning arm with a layered structure around a core.
Figure 5A:
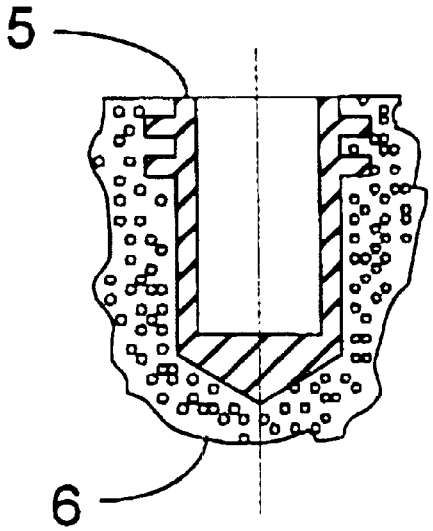
FIG. 5*a* shows the cross section of a semifinished product in part of a positioning arm based on metal or ceramic foam.
Figure 5B:
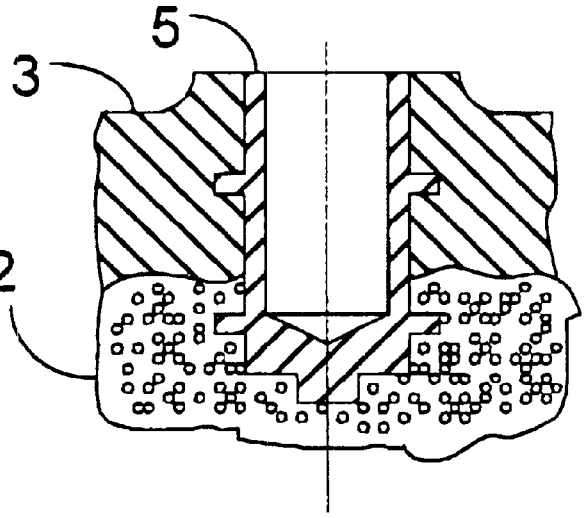
FIGS. 5*b* and 5*c* show in cross section two possibilities for arranging a semifinished product in a positioning arm based on a cast-around metal or ceramic foam.
Figure 5C:
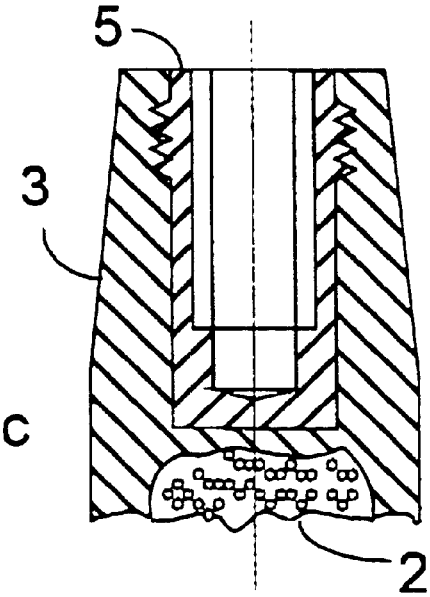

In FIG. 4 it is shown how a core 3 of a non-expanded material, such as for example a semifinished product or a metal casting or metal extruded part is surrounded by an outer layer 3 of metal or ceramic foam, which in turn has a further layer 4 of a metallic or ceramic material cast around it. Suitable for example as semifinished products are threaded inserts or bodies with mounting surfaces, which serve for the connection of the positioning arms to other components. In FIGS. 5*a*, 5*b* and 5*c*, three possibilities for arranging semifinished products in positioning arms are shown. In FIG. 5*a* it is shown how a semifinished product 5 of metal or ceramic foam 6 is surrounded. This embodiment has the disadvantage that, on account of the low surface adhesion between metal or ceramic foam 6 and semifinished product 5, the connection often cannot be adequately subjected to loading. Higher load-bearing capacities are achieved by the embodiment according to FIG. 5*b*, in which the semifinished product 5 is surrounded both by the core 2 of metal or ceramic foam and by the outer layer 3 of metallic or ceramic material. The embodiment according to FIG. 5*c*, in which the semifinished product 5 is surrounded in a known way by the outer layer 3 of the metallic or ceramic material and has no contact with the core 2 of metal or ceramic foam, is also suitable for withstanding high loads.

Figure 6:
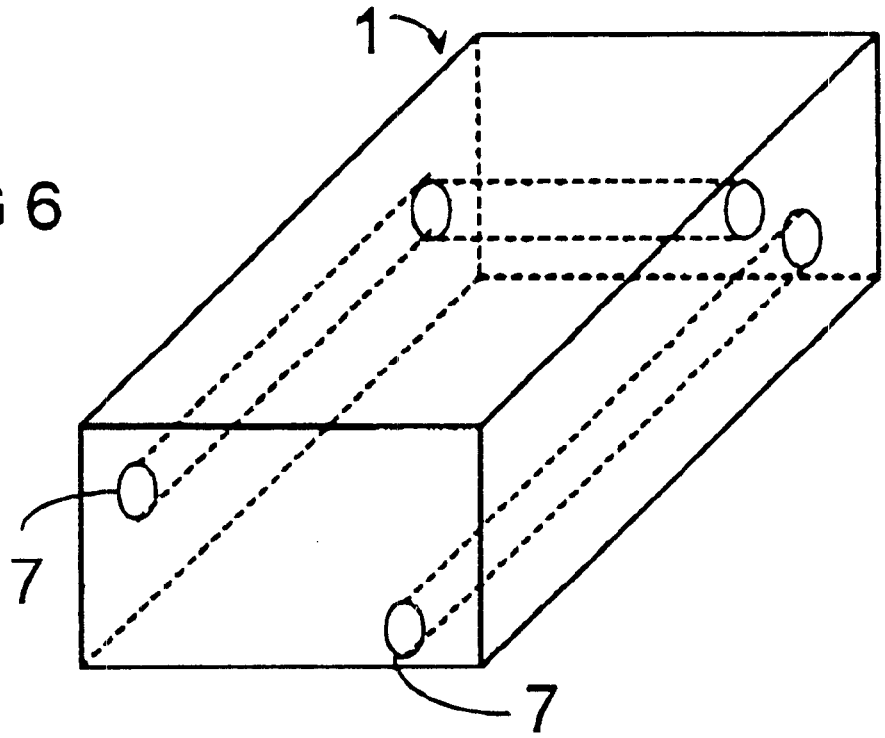
FIG. 6 shows part of a positioning arm with cast-around tubular semifinished products.

The surrounding of tubular semifinished products 7, as shown in FIG. 6, makes it possible to receive cables, which can be led from one end of the positioning arm to the other in the tubular semifinished products, without the risk of cables becoming tangled when the positioning arm is moved.

Figure 8:
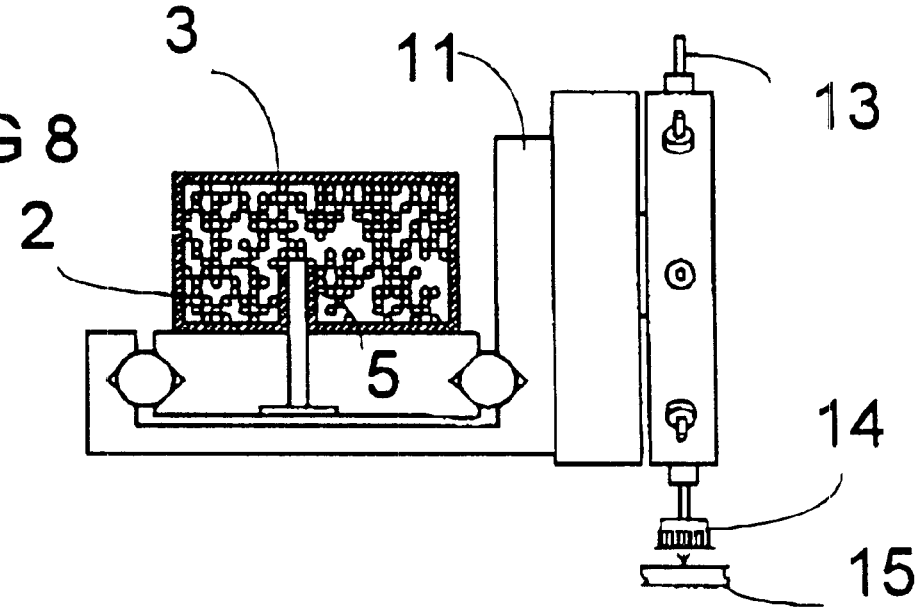
FIG. 7 shows a plan view of a positioning arm with a placement head in use in an automatic placement machine and FIG. 8 shows a section along the line II—II of FIG. 7.
Figure 7:
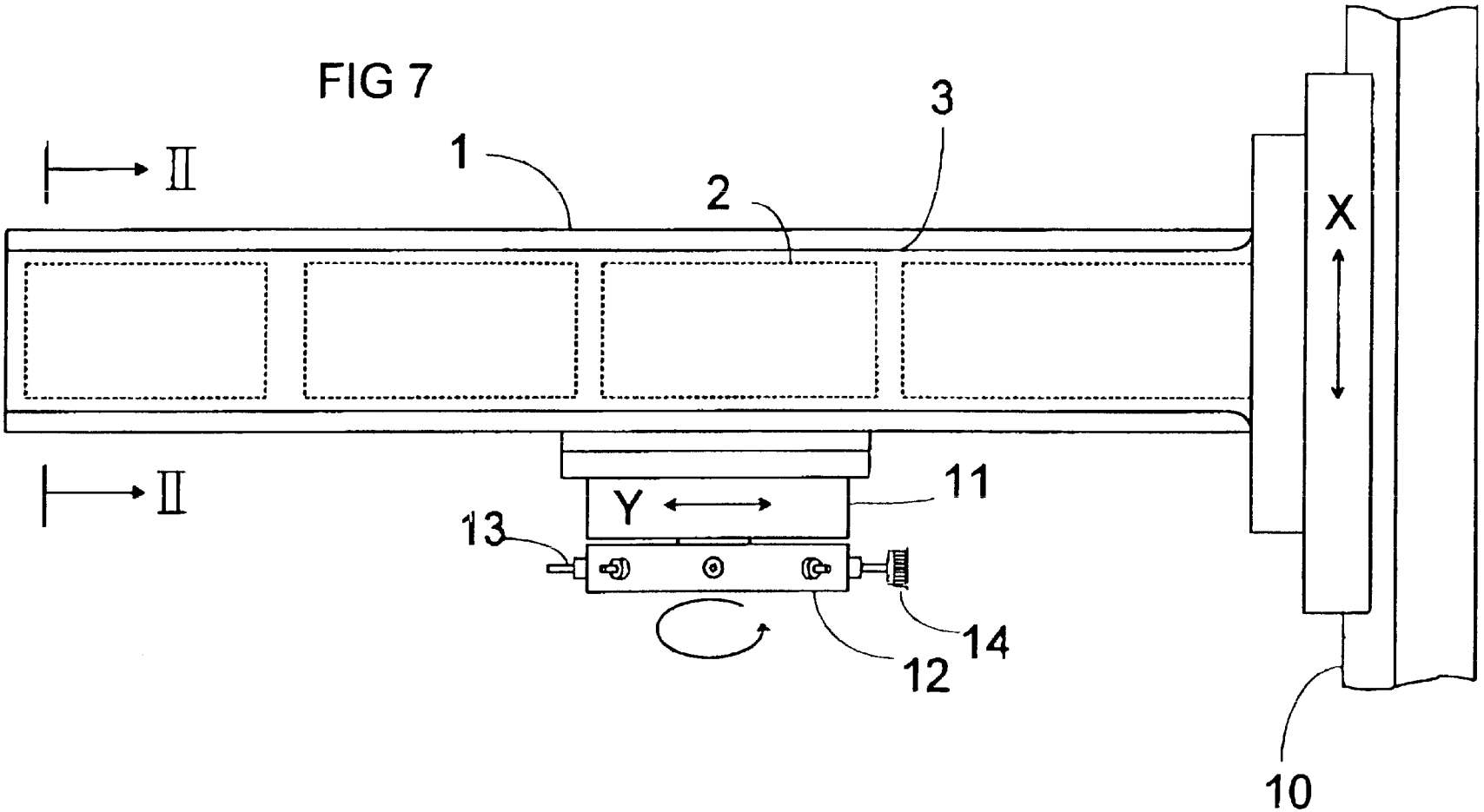

Shown in FIG. 7 is the positioning arm 1 comprising cores 2 and outer layer 3, as it is used in an automatic placement machine. The positioning arm 1 can in this case be moved in the X direction on a rail, 10. Attached in the horizontal region of the positioning arm 1 is a slide 11, which is moved in the Y direction. Connected to the slide 11 is a placement head 12, which receives a plurality of suction pipettes 13 along its circumference. The suction pipettes 13 serve for transporting components 14 from feeding units (not shown) to the desired position of the components 14 on a printed-circuit board 15, as is shown in FIG. 8. The placement head 13 is in this case rotatably mounted, so that altogether, for example, twelve suction pipettes 13 can be used for initially removing twelve components 13 from the feeding units, before these twelve components 13 are placed one after the other onto the printed-circuit board 15.

The cross section in FIG. 8 reveals the connection between the slide 11 and the positioning arm 1, which is ensured by a semifinished product 5 introduced by the method according to the invention.

The invention comprises all further conceivable combinations of metal foams with metallic and/or ceramic materials not presented here in detail but obvious to a person skilled in the art. For example, layered structures can also be realized by surrounding metallic or ceramic cores with metal or ceramic foam and subsequent further casting around with metallic and/or ceramic materials.

The methods described are suitable in particular for realizing positioning arms in automatic placement machines, which are subjected to particularly strong acceleration forces. The method is also suitable for highly accelerated components on machines of which the transient characteristics have a strong influence on positioning duration and positioning accuracy.

As already mentioned, the use of aluminum or aluminum alloys as the metal or ceramic foam and/or non-expanded material leads to particularly lightweight positioning arms by virtue of the low specific weight of aluminum.

Although various minor changes and modifications might be proposed by those skilled in the art, it will be understood that our wish is to include within the claims of the patent warranted hereon all such changes and modifications as reasonably come within our contribution to the art.

What is claimed is:

1. A positioning arm for positioning and assembling systems, comprising:

at least one core and an outer layer enclosing the core; and the core being formed of a metal or ceramic foam and the outer layer being formed of a non-expanded material, wherein further layers of metal or ceramic foam and non-expanded material are arranged in alternating fashion around the outer layer.

2. The positioning arm of claim 1 wherein a plurality of cores are jointly enclosed by the outer layer.

3. The positioning arm of claim 1 wherein semifinished products are at least partly arranged in the non-expanded material.

4. The positioning arm of claim 1 wherein the metal foam is formed of aluminum foam or foam of an aluminum alloy.

5. The positioning arm of claim 1 wherein the non-expanded material is formed of aluminum or an aluminum alloy.

6. The positioning arm of claim 1 wherein the non-expanded material is formed of a ceramic material.

7. A positioning arm for positioning and assembling systems, comprising:

at least one core and an outer layer enclosing the core; and the core being formed of a non-expanded material and the outer layer being formed of a metal or ceramic foam, wherein further layers of metal or ceramic foam and non-expanded material are arranged in alternating fashion around the outer layer.

8. The positioning arm of claim 7 wherein a plurality of cores are jointly enclosed by the outer layer.

9. The positioning arm of claim 7 wherein semifinished products are at least partly arranged in the non-expanded material.

10. The positioning arm of claim 7 wherein the metal foam is formed of aluminum foam or foam of an aluminum alloy.

11. The positioning arm of claim 7 wherein the non-expanded material is formed of aluminum or an aluminum alloy.

12. The positioning arm of claim 7 wherein the non-expanded material is formed of a ceramic material.

13. A method for producing a positioning arm for positioning and assembling systems, comprising:

producing at least one core from a metal or ceramic foam; and surrounding the at least one core by an outer layer of non-expanded material, wherein the outer layer is surrounded by further layers of metal or ceramic foam and non-expanded materials in alternating fashion.

14. The method for producing a positioning arm of claim 13 wherein a plurality of cores are produced, and the cores are jointly surrounded by the outer layer.

15. The method for producing a positioning arm of claim 13 wherein a metallic material is used as the non-expanded material and the core is surrounded by the metallic material by means of a die casting method.

16. The method for producing a positioning arm of claim 13 wherein a ceramic material is used as the non-expanded material, and the ceramic material is subsequently fired.

17. The method for producing a positioning arm of claim 13 wherein semifinished products have the metallic material cast around them together with the cores.

18. A The method for producing a positioning arm of claim 13 wherein aluminum foam or a foam based on an aluminum alloy is used as the metal foam.

19. The method for producing a positioning arm of claim 13 wherein aluminum or an aluminum alloy is used as the non-expanded material.

20. A method for producing a positioning arm for positioning and assembling and assembly systems, comprising:

producing at least one core from a non-expanded material; and surrounding the at least one core by an outer layer of a metal or ceramic foam, wherein the outer layer is surrounded by further layers of metal or ceramic foam and non-expanded materials in alternating fashion.

21. The method for producing a positioning arm of claim 20 wherein a plurality of cores are produced, and the cores are jointly surrounded by the outer layer.

22. The method for producing a positioning arm of claim 20 wherein a metallic material is used as the non-expanded material and the core is surrounded by the metallic material by means of a die casting method.

23. The method for producing a positioning arm of claim 20 wherein a ceramic material is used as the non-expanded material, and the ceramic material is subsequently fired.

24. The method for producing a positioning arm of claim 20 wherein semifinished products have the metallic material cast around them together with the cores.

25. The method for producing a positioning arm of claim 20 wherein aluminum foam or a foam based on an aluminum alloy is used as the metal foam.

26. The method for producing a positioning arm of claim 20 wherein aluminum or an aluminum alloy is used as the non-expanded material.

* * * * *